United States Patent [19]

Gelfand

[11] 4,440,055

[45] Apr. 3, 1984

[54] MAT CUTTING DEVICE

[76] Inventor: Daniel Gelfand, 200 Winston Dr., Cliffside Park, N.J. 07010

[21] Appl. No.: 336,086

[22] Filed: Dec. 31, 1981

[51] Int. Cl.[3] ..... B26D 5/08

[52] U.S. Cl. ..... 83/529; 83/564; 83/581; 83/614; 83/699

[58] Field of Search ..... 83/614, 655, 564, 395, 83/554, 555, 581, 482, 529, 699

[56] References Cited

U.S. PATENT DOCUMENTS

| | | | |
|---|---|---|---|
| 611,238 | 9/1898 | Drinkaus | 83/614 |
| 3,130,622 | 4/1964 | Eno | 83/564 |
| 3,213,736 | 10/1965 | Keeton | 83/455 |
| 3,463,041 | 8/1969 | Shapiro et al. | 83/614 |
| 3,628,412 | 12/1971 | Rogers, Jr. | 83/455 |
| 3,779,119 | 12/1973 | Broides | 83/614 |
| 3,897,706 | 8/1975 | Martin | 83/614 |
| 3,903,767 | 9/1975 | Kupersmith | 83/614 |
| 3,918,337 | 11/1975 | Lindlad et al. | 83/614 |
| 3,964,360 | 6/1976 | Schwartz | 83/614 |
| 3,967,519 | 7/1976 | Esterly | 83/455 |
| 3,973,459 | 8/1976 | Stowe | 83/614 |
| 3,996,827 | 12/1976 | Logan | 83/614 |
| 4,022,095 | 5/1977 | Jones | 83/614 |
| 4,096,631 | 6/1978 | Ward | 30/294 |
| 4,249,437 | 2/1981 | Hagenson | 83/39 |

*Primary Examiner*—E. R. Kazenske

*Assistant Examiner*—Hien H. Phan

*Attorney, Agent, or Firm*—Karl F. Ross; Herbert Dubno

[57] ABSTRACT

A mat cutting device has a planar base for supporting a mat to be cut, the base having a pair of supports, each at opposite sides thereof with a guide rod mounted therebetween and having a longitudinal axis parallel to the base. An elongated cutting head having a blade at one end thereof is mounted at the other end opposite the blade on the guide rod, the cutting head being longitudinally displaceable therealong and pivotable about the rod axis, the cutting head being engageable with a movable stop mounted on one of the supports and being axially adjustable for stopping the cutting head at a predetermined distance from the support and for keeping the cutting head with the blade thereof tilted upwardly for allowing insertion and removal of the mat therebeneath. The cutting head is provided with a blade holder which extends through the head, parallel to the rod axis, and engages the blade in a transverse slot formed in the holder and secures the blade in indexing grooves formed on at least one side of the cutting head, the grooves being formed at different angles for allowing the blade to make bevel cuts and straight cuts. A slide block pivotally mounted on the cutting head rides along the surface of the mat and holds it down while maintaining the depth of cut of the blade.

10 Claims, 4 Drawing Figures

MAT CUTTING DEVICE

FIELD OF THE INVENTION

The present invention relates, in general, to a device for cutting paper, and, more particularly, to a device for making linear cuts in paper mats used for picture framing, the cuts being perpendicular to the surface thereof or at an angle to the surface, i.e. bevel cuts.

BACKGROUND OF THE INVENTION

Mat cutting devices similar to that of the present invention are well known in the art, but each of these has a specific disadvantage which is obviated by the mat cutter of the present invention.

For example, U.S. Pat. No. 3,213,736 discloses a mat cutting device having a base and a single cylindrical guide rod along which a cutting head is displaceable, the cutting head having a pair of blades, one arranged vertically and the other an at angle, each blade being provided with a handle for pivoting the blade downwardly parallel to the guide rod for cutting the mat, and a mat holder fixedly mounted on the guide rod and extending the length thereof.

In another example, U.S. Pat. No. 3,628,412 discloses a mat cutter having a base and a single rectangular guide rod along which a cutting head having two vertically disposed blades is displaceable, with a mat holder mounted in the guide rod and extending the length thereof.

Further examples of the mat cutting art are disclosed in U.S. Pat. Nos. 3,897,706 and 3,996,827 which are so similar to U.S. Pat. No. 3,213,736, that any discussion of these patents would be redundant.

U.S. Pat. No. 4,022,095 discloses a mat cutter having a base and a guide rod in the form of an inverted V which holds down the mat while a cutting head, also in the form of an inverted V and having a blade arranged on one leg thereof, is displaced along the guide rod.

Citation of U.S. Pat. No. 4,096,631 is made for the record, but is so similar to U.S. Pat. No. 4,022,095, that once again, further discussions would be redundant.

U.S. Pat. No. 4,249,437 discloses having a movable belt on which the mat is carried and a pair of cutting heads mounted on guide rods and dispaceable therealong by a threaded rod to adjust the distance therebetween, the guide rods being mounted on a carriage which moves the cutting heads in the cutting direction, making a pair of parallel simultaneous cuts.

U.S. Pat. No. 3,967,519 discloses a pair of parallel guide rods mounted at their ends on parallel rails transverse to the rods, the rods being displaceable therealong. A carriage is slidably mounted between the guide rods and carries a rotatable cutting head indexed at 90° intervals for cutting rectangles without moving the mat, the head being provided with a single blade and a non-tilting slide block or foot.

Finally, U.S. Pat. No. 3,973,459 discloses a single guide rod acting as a mat holder and carrying a cutting head having a blade arranged at a fixed angle.

These examples of the state of the art regarding mat cutting devices have the common disadvantage in that they are all complicated pieces of equipment, some of them extremely so, and all use some sort of hold-down device for the mat, some of which are part of the base and some of which are integral with the guide rod, none of which move with the cutting head, with the exception of the sliding foot of U.S. Pat. No. 3,967,519, which could scar the surface of the mat during the cutting operation, and which in addition, uses hold-down bars which are part of the base.

Some of the devices in the examples have handles on the cutting head for driving the blades into the mat, these handles making the cutting head cumbersome and hard to operate.

In some of the examples given, dual blades are used on the cutting head, one for making straight cuts and the other for making bevel cuts, adding to the cost and complexity of the device. In the cutting devices where only one blade is used, only one kind of cut can be made.

OBJECTS OF THE INVENTION

It is therefore an object of the present invention to provide an improved mat cutting device which is of simple construction and easy to use.

It is another object of the invention to provide a mat cutting device in which a single blade can be used to make straight or bevel cuts.

It is further an object of the invention to provide a mat cutting device in which the means for holding down the mat is contained in the cutting head.

SUMMARY OF THE INVENTION

The above and other objects of the invention are realized in a mat cutting device having a planar base on which there are oppositely disposed, parallel end rails, with a cylindrical guide rod fixedly mounted therebetween, the rod being perpendicular to the end rails and having a longitudinal axis parallel to the base.

A cutting head has a body in the form of an elongated yoke having a pair of downwardly extending flanks in which there are formed a pair of inline openings at one end through which the guide rod passes to axially guide the cutting head therealong, as well as allowing pivotal movement about the guide rod. A slide block having a plurality of smooth faces is pivotally mounted between the flanks of the cutting head on a blade holder at the other end thereof, which passes therethrough and has one end secured to one of the flanks by a screw, and the other end extending beyond the other flank and being formed with a transverse slot into which a cutting blade is fitted and indexed into either a vertical groove or an angled groove formed in the outer face of the flank confronting the blade, and the screw on the blade holder tightened to draw the slot toward the flank and thereby secure the blade in the groove.

In operation, the cutting head is tilted with the blade upwardly and can be held in that position by a rod-like stop provided on one of the end rails which can engage the cutting head, while a mat to be cut is positioned beneath the cutting head. The cutting head is then pivoted with the blade downwardly, the blade piercing the mat and the cutting head then displaced across the mat, with one of the faces of the slide block riding on the surface of the mat, the block tilting gently as little unevenesses in the mat are encountered, while at the same time holding the mat down and maintaining the depth of cut of the blade.

In another embodiment of the invention, the guide rod is pivotally mounted on the end rails and the cutting head is pivotally fixed to the guide rod, though still axially displaceable therealong. Also, the cutting head is formed with indexing grooves in both flanks, so that the blade can be mounted on either side of the cutting head by simply reversing the blade holder, thereby allowing right-or-left hand use of the cutting machine.

BRIEF DESCRIPTION OF THE DRAWING

The above and other objects, features and advantages of the invention will become more readily apparent from the following description, reference being made to accompanying drawing, in which.

SPECIFIC DESCRIPTION

Figure 1:
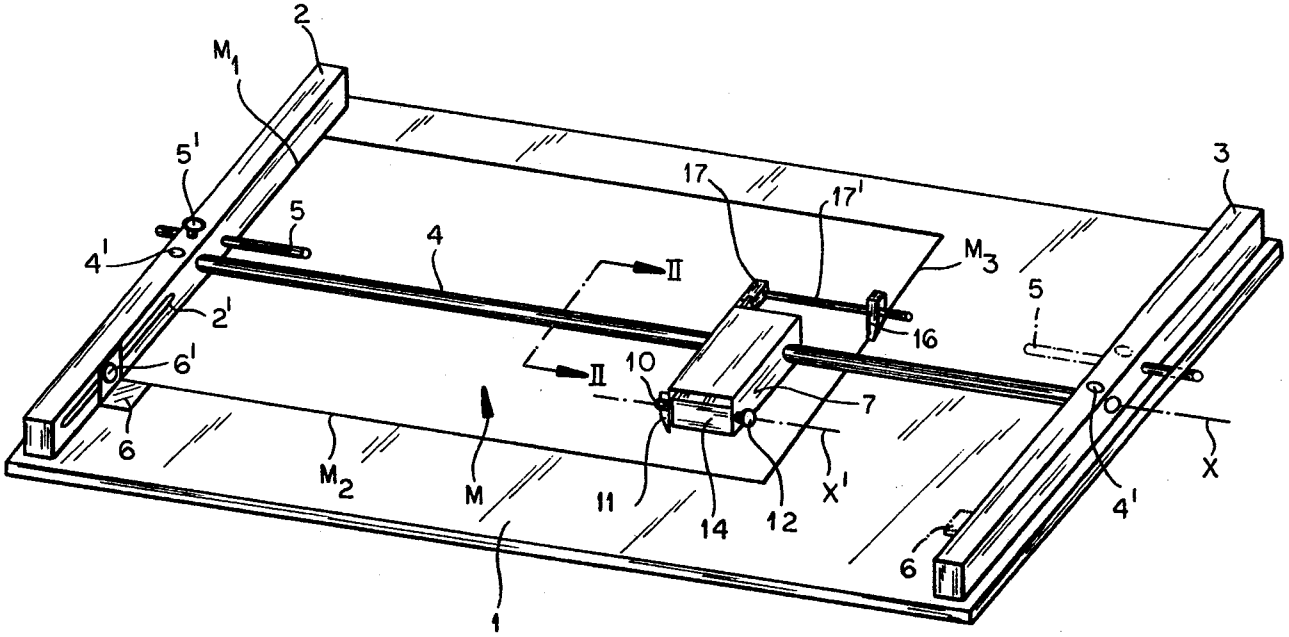
FIG. 1 is a perspective view of a mat cutting device according to the invention.

The mat cutting device illustrated in FIG. 1 has a planar base 1 having a pair of oppositely disposed, parallel end rails 2 and 3, with a cylindrical guide rod 4 fixedly mounted therebetween by pins 4', the rod being perpendicular to the rails and having a longitudinal axis X parallel to the base 1. The rail 2 is provided with a rod-like adjustable stop 5 adjacent the guide rod 4 and held against axial displacement by a screw 5'. An L-shaped adjustable stop 6 is also provided on the rail 2 and displaceable therealong perpendicular to axis X in a slot 2' formed in the rail 2 and engaged by a screw 6'.

Figure 3:
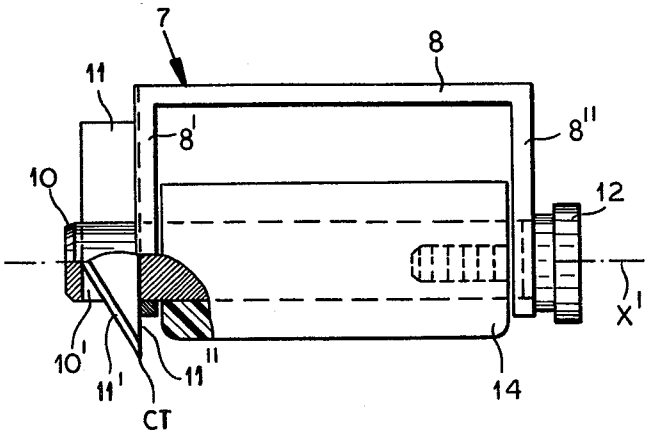
FIG. 3 is a right-end elevational view of the cutting head of FIG. 2 with a portion thereof shown in section.
Figure 2:
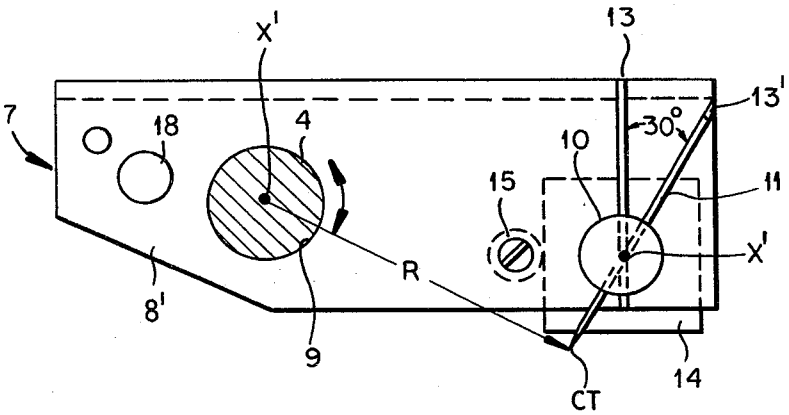
FIG. 2 is an elevational view of one side of the cutting head of the device taken along line II—II of FIG. 1.

As shown in FIG. 2 and 3, a cutting head 7 has a body formed by a yoke 8 having downwardly extending flanks 8' and 8'' in which are formed openings 9 in alignment with one another and through which the guide rod 4 passes, the cutting head 7 being pivotally mounted thereon and axially displaceable therealong.

A blade holder in the form of a bolt 10 having a longitudinal axis X' parallel to axis X, extends from the flank 8'' to the flank 8' and beyond and formed thereat with a transverse slot 10', through which a flat cutting blade 11 having a cutting edge 11' can be fitted. A screw 12 threadly engages the other end of bolt 10 at the flank 8'' and when tightened, acts to hold the blade 11 against the outer face of flanks 8', in which there are formed grooves 13 and 13', in which the rear edge 11'' of blade 11 can be engaged to maintain a particular cutting angle, the groove 13 being formed at 90° and the groove 13' at 60°.

A slide block 14 is pivotally mounted on bolt 10 between the flanks 8' and 8'', with one of the faces of the block 14 extending below the lower edges of the flanks. The pivotal movement of the block 14 is limited by a stud 15, which is closely spaced from a face of the block and extends from flank to flank and is threaded thereto.

The cutting head 7 is further provided with a flip-stop 16, pivotally mounted thereon by a hinge 17 carrying a rod 17' on which the flip-stop 16 is adjustable.

In operation, the screw 12 is loosened and the blade 11 is indexed into the proper groove, depending on whether a straight cut or bevel cut is made, and the depth of cut of the blade 11 is adjusted by the distance of the cutting tip CT thereof below the bottom face of the block 14.

The cutting head 7, so adjusted and with the screw 12 tightened, is pivoted with the blade 11 upwardly and moved to the extreme left in FIG. 1, where a bore 18 formed in flank 8' receives the rod-like stop 5, the bore 18 being so positioned as to keep the cutting head 7 with the blade 11 tilted upwardly, so that a mat M, in which a rectangular cutout is to be made, can be fitted beneath the cutting head with an edge $M_1$ thereof abutting the rail 2 and another edge $M_2$ being engaged by the L-shaped stop 6, for positioning the mat M relative to the cutting tip CT, in accordance with the dimensions of the cutout to be made, adjustments to the rod-like stop 5 and the flip-stop 16 also being made according to these dimensions.

The cutting head 7, with the mat M in place, is moved to the right while hand-held in the tilted position until the flip-stop 16 clears the edge $M_3$ of the mat, the head then being moved again to the left until the flip-stop engages the edge $M_3$, the cutting head 7 now being tilted downwardly to drive the cutting tip CT into the mat M until the block 14 engages same. The flip-stop 16 is now pivoted upwardly out of engagement with the edge $M_3$ and the cutting head 7 is moved to the left with the block 14 riding on the surface of the mat and holding it down until it meets the stop 5, at which point the head 7 is again tilted with the blade 11 upwardly and the bore 18 engaged by the stop 5, allowing the mat M to be turned so that another section of the cutout can be made.

When the blade 11 is set in the groove 13' for making bevel cuts, cutting tip CT lies substantially perpendicular to a radius R of the axis X, so that no deflecting stresses act on the cutting blade during the cutting operation.

Figure 4:
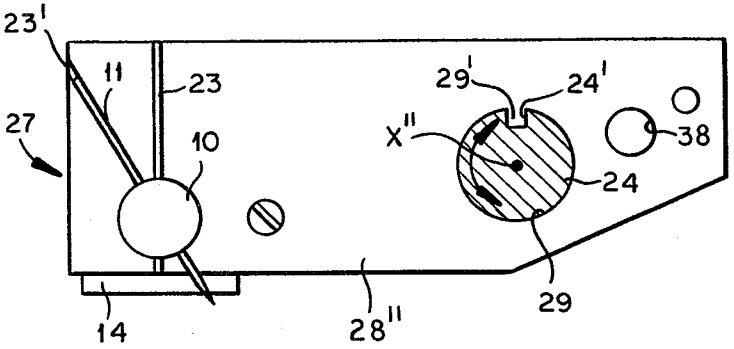
FIG. 4 is a view similar to FIG. 2, but taken from the other side of the cutting head and showing another embodiment of the invention.

In another embodiment of the invention shown in FIG. 4, a cutting head 27 is mounted on a guide rod 24 and pivotally fixed thereto by a tongue 29' of opening 29 which extends into a groove 24' of guide rod 24, which is pivotally mounted on the end rails 2 and 3, the guide rod 24 having a longitudinal axis X'' about which the cutting head 27 is pivotable, the head 27 being longitudinally displaceable therealong. The flank 28'' of head 27 shown in FIG. 4 is similar to the flank 8'' of FIG. 3, except for the grooves 23 and 23' formed therein and the equivalent of grooves 13 and 13', so that the bolt 10 may simply be reversed, allowing the blade 11 to be used on either side of the cutting head 27 for permitting either right- or left-hand use. The flank 28'' is also formed with a bore 38 similar to the bore 18 and acts to receive the rod-like stop 5 when that stop is removed from the rail 2 and mounted on the rail 3, along with the L-shaped stop 6, as shown in phantom lines in FIG. 1. Except for these differences, all of the other elements of the cutting head 27 are identical to those of cutting head 7 and have been numbered accordingly.

I claim:

1. A mat cutting device comprising:

a planar base for supporting a mat to be cut;

a first support at one side of said base;

a second support at an opposite side of said base;

a guide rod mounted between said first and second supports, said guide rod having a longitudinal axis parallel to said base;

an elongated cutting head having a blade at one end thereof and mounted at the other end opposite said blade on said guide rod, said cutting head being provided with means for the longitudinal along displacement and the pivotal displacement of said head about said axis;

a movable stop mounted on said first support, said stop being axially adjustable and engageable with said cutting head for stopping same at a predetermined distance from said first support, said stop having means for keeping said cutting head with said blade thereof tilted upwardly for allowing the insertion and removal of said mat therebeneath;

means on said cutting head for adjusting a cutting angle of said blade with respect to said base; and means on said cutting head for adjusting a depth of cut of said blade in said mat.

2. The device defined in claim 1 wherein said first and second supports are formed respectively by first and second rails arranged parallel to one another with said guide rod mounted therebetween and perpendicular thereto, said first rail acting as a guide for a first edge of said mat and being further provided with a second movable stop mounted thereon, said second stop being positionable for engagement with a second edge of said mat and being provided with means for enabling displacement of said second stop along said first rail for positioning said mat beneath said blade, and said cutting head is further provided with means tiltably mounted thereon for riding on and holding down said mat and maintaining the depth of cut therein.

3. The device defined in claim 2 wherein said cutting head is formed by a yoke having first and second downwardly extending flanks, said first and second flanks being formed with respective openings in alignment with one another through which said guide rod passes, and said means for adjusting the depth of cut of said blade is a bolt having a second longitudinal axis parallel to said rod axis spanning said first and second flanks and extending beyond said first flank and formed thereat with a throughgoing transverse slot receiving said blade, the other end of said bolt being threadedly engaged at said second flank for securing said blade against the outer face of said first flank.

4. The device defined in claim 3 wherein said means for holding down said mat and maintaining the depth of cut of said blade therein is a slide block pivotally mounted on said bolt between said first and second flanks and having a plurality of faces parallel to said second axis, one of said faces extending downwardly below the lower edges of said first and second flanks and riding along the upper surface of said mat.

5. The device defined in claim 3 wherein said means for adjusting the cutting angle of said blade is a plurality of grooves formed on an outer face of said first flank and having planes intersecting at said second axis, said grooves being adapted to receive and hold an edge of said blade, with at least one of said grooves holding said blade substantially perpendicular to a radius of said first axis, said first flank being formed with a bore adapted to receive said movable stop.

6. The device defined in claim 4, further comprising a removable stud extending between said first and second flanks, parallel to said second axis and closely spaced from one of said faces for allowing limited pivotal movement of said block when said stud is in place in said cutting head and for allowing said block to be rotated to present a new face to said mat when said stud is removed from said cutting head.

7. The device defined in claim 3, further comprising a third stop provided with means to pivotally mount it on said cutting head for engagement with a third edge of said mat for positioning said cutting head prior to cutting, said third stop being mounted for displacement to release said third edge when cutting commences.

8. The device defined in claim 5 wherein said second flank of said cutting head is formed with a plurality of second grooves identical to said grooves in said first flank for receiving said blade when said bolt is reversed in said cutting head for allowing right- or left-hand use thereof.

9. The device defined in claim 1 wherein said guide rod is fixedly mounted in said first and second supports and said cutting head is pivotally mounted on said guide rod.

10. The device defined in claim 1 wherein said guide rod is pivotally mounted in said first and second supports and said cutting head is pivotally fixed on said guide rod.

* * * * *